US011504739B2

(12) United States Patent
Zahlen

(10) Patent No.: US 11,504,739 B2
(45) Date of Patent: Nov. 22, 2022

(54) DEVICE FOR LACQUER TRANSFER

(71) Applicant: Airbus Operations GmbH, Hamburg (DE)

(72) Inventor: Pierre C. Zahlen, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 115 days.

(21) Appl. No.: 16/829,880

(22) Filed: Mar. 25, 2020

(65) Prior Publication Data

US 2020/0306791 A1 Oct. 1, 2020

(30) Foreign Application Priority Data

Mar. 29, 2019 (DE) ..... 10 2019 108 280.3

(51) Int. Cl.
*B05C 1/08* (2006.01)
*B05C 9/10* (2006.01)
(Continued)

(52) U.S. Cl.
CPC ..... *B05D 1/325* (2013.01); *B05C 1/0808* (2013.01); *B05C 9/10* (2013.01); *B05C 21/005* (2013.01);
(Continued)

(58) Field of Classification Search
None
See application file for complete search history.

(56) References Cited

U.S. PATENT DOCUMENTS 2,218,112 A 10/1940 Kaufman
3,962,025 A 6/1976 Jacobson
(Continued)

FOREIGN PATENT DOCUMENTS

CN 102 463 293 A 5/2012
DE 34 19 867 C1 9/1985
(Continued)

OTHER PUBLICATIONS

European Search Report for Application No. 20166215.2 dated Sep. 7, 2020.
(Continued)

*Primary Examiner* — Jethro M. Pence
(74) *Attorney, Agent, or Firm* — Jenkins, Wilson, Taylor & Hunt, P.A.

(57) ABSTRACT

A device and method for lacquer transfer includes a lacquer application unit and at least one of a masking application unit and a masking removal unit, the application unit for applying lacquer to a work surface, wherein the masking application unit is configured to apply a masking to the work surface and is attached to the lacquer application unit so the masking application unit is moved in the application direction ahead of the lacquer application unit across the work surface when the lacquer application unit is moved across the work surface in the application direction. The masking removal unit can remove a previously applied masking from the work surface and is attached to the lacquer application unit such that the masking removal unit is moved in the application direction behind the lacquer application unit across the work surface when the lacquer application unit is moved across the work surface in the application direction.

16 Claims, 4 Drawing Sheets

(51) Int. Cl.

| | |
|---|---|
| ***B05C 9/12*** | (2006.01) |
| ***B05D 1/32*** | (2006.01) |
| ***B05C 21/00*** | (2006.01) |
| *B05D 5/00* | (2006.01) |
| *B05D 1/28* | (2006.01) |

(52) U.S. Cl.
CPC ..... *B05C 9/12* (2013.01); *B05D 1/28* (2013.01); *B05D 5/00* (2013.01)

(56) References Cited

U.S. PATENT DOCUMENTS

| | | | | |
|---|---|---|---|---|
| 4,885,187 | A * | 12/1989 | Koenig | B05D 1/325 427/195 |
| 4,974,532 | A * | 12/1990 | March | B05B 12/22 118/301 |
| 5,107,788 | A | 4/1992 | Boldrini et al. | |
| 5,126,529 | A * | 6/1992 | Weiss | B33Y 10/00 118/313 |
| 5,154,797 | A * | 10/1992 | Blomquist | C23C 14/042 216/48 |
| 5,425,848 | A | 6/1995 | Haisma et al. | |
| 6,174,567 | B1 | 1/2001 | Ueberschär et al. | |
| 6,344,088 | B1 | 2/2002 | Kamkihara et al. | |
| 6,554,900 | B1 | 4/2003 | Aydin et al. | |
| 6,627,262 | B1 | 9/2003 | Soas et al. | |
| 9,808,823 | B2 | 11/2017 | Pagendarm et al. | |
| 10,173,238 | B2 | 1/2019 | Sturm et al. | |
| 10,335,824 | B2 | 7/2019 | Mueller | |
| 11,241,708 | B2 | 2/2022 | Zahlen et al. | |
| 11,267,014 | B2 | 3/2022 | Zahlen et al. | |
| 2001/0032585 | A1 | 10/2001 | Koehn et al. | |
| 2002/0108635 | A1 | 8/2002 | Marrero | |
| 2005/0061655 | A1 | 3/2005 | Gros et al. | |
| 2006/0066703 | A1 | 3/2006 | Kadomatsu et al. | |
| 2010/0080958 | A1 | 4/2010 | Goelling | |
| 2010/0233354 | A1 | 9/2010 | Barral et al. | |
| 2012/0148727 | A1 | 6/2012 | Heo et al. | |
| 2012/0313274 | A1 | 12/2012 | Loukusa et al. | |
| 2013/0341497 | A1 | 12/2013 | Zuardy et al. | |
| 2014/0305583 | A1 | 10/2014 | Casset | |
| 2015/0064389 | A1 | 3/2015 | Zahlen et al. | |
| 2015/0251409 | A1 | 9/2015 | Ohnishi | |
| 2015/0273762 | A1 | 10/2015 | Okamoto | |
| 2016/0045927 | A1 | 2/2016 | Svec | |
| 2017/0080454 | A1 | 3/2017 | Hidaka et al. | |
| 2017/0095831 | A1 | 4/2017 | Sturm et al. | |
| 2017/0266691 | A1 | 9/2017 | Travis | |
| 2018/0281297 | A1 | 10/2018 | Pringle et al. | |
| 2020/0306785 | A1 | 10/2020 | Zahlen et al. | |
| 2020/0306786 | A1 | 10/2020 | Zahlen et al. | |
| 2020/0306787 | A1 | 10/2020 | Zahlen et al. | |
| 2020/0324310 | A1 | 10/2020 | Zahlen et al. | |
| 2020/0324315 | A1 | 10/2020 | Zahlen et al. | |
| 2020/0353498 | A1 | 11/2020 | Kerger et al. | |

FOREIGN PATENT DOCUMENTS

| | | | |
|---|---|---|---|
| DE | 37 21 593 | A1 | 1/1989 |
| DE | 694 05 451 | T2 | 3/1998 |
| DE | 699 10 430 | T2 | 3/2004 |
| DE | 699 24 956 | T2 | 9/2005 |
| DE | 10 2014 104 340 | A1 | 10/2015 |
| DE | 10 2014 015 622 | A1 | 4/2016 |
| DE | 20 2016 101 299 | U1 | 6/2017 |
| DE | 10 2016 224 592 | A1 | 6/2018 |
| EP | 0 408 283 | A2 | 1/1991 |
| EP | 1 034 905 | A2 | 9/2000 |
| EP | 1 117 488 | B1 | 5/2004 |
| EP | 2 021 180 | B1 | 11/2011 |
| EP | 3 248 692 | A1 | 11/2017 |
| EP | 3 263 447 | A1 | 1/2018 |
| EP | 2 632 605 | B1 | 5/2019 |
| EP | 3 722 007 | A1 | 10/2020 |
| EP | 3 722 009 | A1 | 10/2020 |
| EP | 3 725 422 | A1 | 10/2020 |
| EP | 3 725 539 | A1 | 10/2020 |
| EP | 3 733 300 | A1 | 11/2020 |
| EP | 3 750 637 | A1 | 12/2020 |
| GB | 1 555 771 | A | 11/1979 |
| JP | S60250936 | A | 12/1985 |
| JP | S63274748 | A | 11/1988 |
| JP | 2005-034740 | A | 2/2005 |
| JP | 2006-026558 | A | 2/2006 |
| JP | 2008-086882 | A | 4/2008 |
| KR | 2001/0093377 | A | 10/2001 |
| TW | 2011 03647 | A | 2/2011 |
| WO | WO 89/11343 | A2 | 11/1989 |
| WO | WO 99/60210 | A1 | 11/1999 |
| WO | WO 02/026399 | A1 | 4/2002 |
| WO | WO 2010/146998 | A1 | 12/2010 |
| WO | WO 2015/064685 | A1 | 5/2015 |
| WO | WO 2015/155128 | A1 | 10/2015 |
| WO | WO 2018/150190 | A1 | 8/2018 |

OTHER PUBLICATIONS

European Search Report for Application No. 20164300.4 dated Sep. 29, 2020.
European Search Report for Application No. 20164755.9 dated Sep. 15, 2020.
European Search Report for Application No. 20164573.6 dated Sep. 15, 2020.
European Search Report for Application No. 20164756.7 dated Sep. 21, 2020.
European Search Report for Application No. 20168066.7 dated Sep. 22, 2020.
Non-Final Office Action for U.S. Appl. No. 16/829,914 dated Jul. 21, 2021.
Non-Final Office Action for U.S. Appl. No. 16/829,925 dated Sep. 1, 2021.
Non-Final Office Action for U.S. Appl. No. 16/644,132 dated May 13, 2021.
Non-Final Office Action for U.S. Appl. No. 16/829,898 dated Jun. 9, 2021.
Restriction Requirement for U.S. Appl. No. 16/843,112 dated Sep. 8, 2021.
Notice of Allowance for U.S. Appl. No. 16/844,132 dated Oct. 4, 2021.
Corrected Notice of Allowance for U.S. Appl. No. 16/844,132 dated Oct. 15, 2021.
Final Office Action for U.S. Appl. No. 16/829,914 dated Nov. 9, 2021.
Notice of Allowance for U.S. Appl. No. 16/829,898 dated Nov. 19, 2021.
Corrected Notice of Allowance for U.S. Appl. No. 16/844,132 dated Dec. 8, 2021.
Corrected Notice of Allowance for U.S. Appl. No. 16/829,898 dated Dec. 13, 2021.
Non-Final Office Action for U.S. Appl. No. 16/843,112 dated Dec. 16, 2021.
Notice of Allowance for U.S. Appl. No. 16/829,914 dated Jan. 20, 2022.
Notice of Allowance for U.S. Appl. No. 16/829,925 dated Mar. 4, 2022.

* cited by examiner

DEVICE FOR LACQUER TRANSFER

CROSS-REFERENCE TO RELATED APPLICATION

This application claims priority to German Patent Application No. 10 2019 108 280.3 filed Mar. 29, 2019, the entire disclosure of which is incorporated by reference herein.

TECHNICAL FIELD

The disclosure herein relates to a device for lacquer transfer comprising a lacquer application unit and methods for operating a device for lacquer transfer.

BACKGROUND

A device for a lacquer transfer is known from WO 2015/155 128 A1. The device disclosed therein is configured for transferring lacquer to a work surface of a work piece and referred to as an applicator. The device comprises a lacquer transfer unit with a frame, a transfer roller and a drive unit. The transfer roller is mounted rotatably about an axis of rotation at the frame and can be driven by the drive unit. In operation, the device is mounted to a robot arm and moved via the robot arm in parallel to the work surface, such that the driven transfer roller roles with an outside contact surface on the work surface. The outside contact surface of the transfer roller is contoured in that it is provided with depressions which are filled with lacquer that has been dispensed by a lacquer dispending unit onto the outside contact surface. When the lacquer is transferred to the work surface from the contoured contact surface, a predefined lacquer structure is created on the work surface. The lacquer structures may, for example, be provided for reducing the resistance of air flowing across the work surface, thereby reducing drag.

When such a device is used for transferring lacquer to create the predefined lacquer structure on the work surface and not an arbitrary structure, many factors of the lacquer transfer have to be tightly controlled. For example, in regions where the application of the lacquer commences or in regions where the application is stopped, it has turned out to be difficult to immediately create the predefined and intended lacquer structures. For example, when the transfer roller is initially placed on the work piece, too much pressure may be applied, the lacquer may not have been dispensed in sufficient amounts onto the outside contact surface and the speed of rotation of the transfer roll may initially not match the speed in which the device is moved in the application direction which creates stick-and-slip effects.

Similar issues may arise when the lacquer transfer is stopped, for example, when the device is lifted away from the work surface or when lacquer dispensing is stopped which may create irregular lacquer structures that do not achieve the intended reduction in flow resistance.

For avoiding irregularities in the start and stop zones, it has been found useful to apply masking to the work surface onto which the transfer roller may be placed before beginning or stopping the lacquer transfer. The lacquer transfer thus begins and finishes on the respective masking. The dimensions of the masking are chosen such that any irregularities of the lacquer application due to the start-up or stopping of the lacquer application or transfer are confined to the masking. Further, areas which must not be covered with lacquer such as screws or gaps in the work surface are also masked.

Currently the masking is applied manually, for example, using masking tape and cardboard. Applying the masking is very time consuming as the placement has to be accurate. Further, removing the masking also has to be performed manually and requires great care to avoid damaging the previously applied lacquer which may be lifted of the work surface, for example, when masking tape is detached from the work surface.

SUMMARY

In view of the above it is an object of the disclosure herein to provide a device and a method to reduce the effort required to provide masking to work surfaces to which lacquer shall be transferred using the lacquer transfer device.

This object is achieved by a device for lacquer transfer and methods for operating a device for lacquer transfer as disclosed herein. Preferred embodiments of the device and the methods are disclosed herein.

In a first aspect a device for lacquer transfer comprising a lacquer application unit and at least one of a masking application unit and a masking removal unit is provided. The lacquer application unit is configured for applying lacquer with a preferably well-defined lacquer structure to a work surface of a work piece while the device is being moved in an application direction across the work surface. The masking application unit is configured to apply a masking to a work surface and is attached to the lacquer application unit such that the masking application unit is moved in the application direction ahead of the lacquer application unit across a work surface when the device is moved across the work surface in the application direction. The masking removal unit is configured to remove a masking from a work surface and is attached to the lacquer application unit such that the masking removal unit is moved in the application direction behind the lacquer application unit across a work surface when the device is moved across the work surface in the application direction.

In other words, the disclosure herein provides for a lacquer transfer device which comprises not only a lacquer transfer unit but additionally at least one of a masking application unit that can apply a masking to a work surface and a masking removal unit that can remove a masking from a work surface. Preferably, the device comprises both a masking application unit and a masking removal unit. This allows the device to mask sections of the work surface and also remove the masking from masked sections after lacquer has been applied to the work surface.

However, it is also possible that the device itself only places the masking on the work surface, i.e., the device only comprises a masking application unit, or that that device only removes existing masking from the work surface, i.e., the device only comprises a masking removal unit. Hence a masking removed from a work surface with a masking removal unit does not necessarily have to be the same masking that was previously placed on the work surface with a masking application unit of the same device. Since the masking application unit and the masking removal unit are part of the device and attached to the lacquer application unit, the entire device may, for example, be releasably connected to a robot arm of a robot. The robot arm may move the device across a work surface in such a way that the application of the masking to the work surface, the transfer of the lacquer to the work surface and the removal of the masking from the work surface can be performed in a single workflow, i.e., in a single pass of the device across the work surface for the entire width in which lacquer can be applied to the work surface using the device simultaneously. The device may be referred to as an applicator or an application head.

Further, the masking placed or removed by the device does not have to a masking were the application of lacquer begins or stops. It is also possible to place or remove intermediate masking that covers, for example, a gap in a wing or an inspection opening that must not be covered by lacquer.

The device for lacquer transfer has the advantage that at least one of the application of masking and the removal of masking is performed by the device itself so that time consuming manual effort can be avoided. Also, since the masking application unit and the masking removal unit are attached to the device the placement and removal of masking is intrinsically aligned with the lacquer application.

In a preferred embodiment in which the device comprises the masking application unit, the masking application unit comprises a reservoir for masking material and a feeder unit for transporting the masking material from the reservoir to the work surface. Alternatively, the masking application unit may comprise the reservoir for masking material and a pick-and-place unit for selectively picking masking material from the reservoir and placing the masking material on the work surface. The pick-and-place unit may, for example, be formed by one or more suction device that can lift a sheet of masking material out of the reservoir and place the sheet onto the work surface.

In a preferred example embodiment, the reservoir is configured to provide masking material in discontinuous sheets of predetermined size or alternatively in continuous form. For example, the reservoir may be formed by a container holding masking sheets of predetermined width, length and thickness that are fed through rollers forming the feeder unit to a work surface. Providing a reservoir for sheets of masking material simplifies the application of the masking as the dimensions covered by the masking material are well-known and complicated cutting or alignment processes can be avoided.

Alternatively, the masking material may be provided in continuous form on a masking material roll. If the masking material is provided in continuous form, it may be necessary to cut the material into the desired shape before it can be applied to a work surface using a pick-and-place unit.

In both embodiments it is possible to modify the dimensions of the area covered by a masking using a cutting assembly provided as part of the masking application unit. This enables a particularly flexible masking of the work surface. For example, areas of different and even complex sizes and shapes may be covered.

The masking material may be covered on the side or surface facing the work surface when arranged thereon with an adhesive but could also be mechanically pressed against the work surface using dedicated rollers until the lacquer has been applied to the masking material.

In a preferred embodiment the masking application unit comprises a cutting assembly for cutting the masking material in at least one of a direction extending perpendicular to the application direction and a direction extending parallel to the application direction. The cutting assembly may, for example, comprise a first cutter for cutting the masking material perpendicular to the application. At least one second cutter may be provided as part of the cutting assembly for cutting the masking material in a direction extending parallel to the application direction. Alternatively, it is also to provide a single cutter that can cut the masking material in two dimensions. Such a cutter may be referred to as a 2D plotter.

Hence, the cutting assembly enables different shapes and sizes of masking to be used for covering areas of different shape of a work surface. A first cutter may be provided for modifying a length of the masking in the application direction and the at least one second cutter may be provided for modifying a width of the masking in a direction extending perpendicular to the application direction. The cutter may, for example, be one of a diamond knife ultrasonic cutter, a roller knife cutter, a plasma cutter, a laser cutter or a heated wire cutter.

It is further preferred if the masking application unit comprises a press roll for pressing the masking material to the work surface. The press roll ensures that the masking material is tightly pressed onto the work surface so that the masking material does not move away or evades when the lacquer application unit comes into contact with the masking material or commences applying lacquer onto the masking material which could deteriorate the quality of the structure of the lacquer applied to the work surface.

In a preferred embodiment in which the device comprises the masking removal unit, the masking removal unit comprises a pick-up device and a removal delimiter. The pick-up device is configured for lifting a masking from the work surface. The removal delimiter is configured for exerting a pressure onto lacquer applied by the lacquer application unit to the work surface for delimiting an area in which the lacquer detaches from the work surface when the pick-up device lifts a masking from the work surface. The at least one removal delimiter may be one of a rearward removal delimiter and a forward removal delimiter or the device may comprise both of a forward removal delimiter and a backward removal delimiter.

For a rearward removal delimiter, the pick-up device is arranged between the lacquer application unit and the rearward removal delimiter. The rearward removal delimiter is configured for exerting a pressure onto lacquer applied by the lacquer application unit to the work surface for delimiting an area in which the lacquer detaches from the work surface when the pick-up device lifts a masking from the work surface in a direction extending antiparallel to the application direction.

The forward removal delimiter is arranged between the lacquer application unit and the pick-up device. The forward removal delimiter is configured for exerting a pressure onto lacquer applied by the lacquer application unit to the work surface for delimiting an area in which the lacquer detaches from the work surface when the pick-up device lifts a masking from the work surface in a direction extending parallel to the application direction.

In other words, the masking removal unit comprises at least two elements: a pick-up device as well as a forward and/or rearward removal delimiter. The pick-up device may, for example, be based on air suction, electrostatic gripping, needle gripping, bonding tape gripping, freeze gripping or magnetic gripping, provided that a magnetic masking material is used.

The removal delimiters may, for example, be blades or scrapers which are lowered onto the already applied and at least partly hardened lacquer. Each removal delimiter exerts a pressure or even cuts into the lacquer when lowered onto the lacquer. Preferably, the removal delimiter is made from a material that cuts through lacquer but does not damage the work surface which can, for example, be achieved using removal delimiters made from plastic. When the pick-up device lifts up the masking device onto which lacquer has been applied, at least some of the lacquer applied to the work surface outside of the masking will also be lifted up. The removal delimiters hold down or cut the lacquer adjacent to the masking and thereby provide a barrier that limits the area in which the lacquer is lifted up. In consequence, once the masking material has been removed, an edge between an area to which lacquer has been applied and an area which is free of lacquer due to the masking is not defined by the masking material itself but by the position of the respective removal delimiter. The removal delimiters may be formed in one piece. However, it is also possible to form the removal delimiter in many independent segments which allows to hold down the lacquer along the edges of complex shaped masking.

The forward removal delimiter is arranged between the lacquer application unit and the pick-up device so that masking can be removed which is provided in the application direction before an area to which lacquer has been or is being applied with the device. Hence, masking may be removed which covers a start region where the lacquer application commences or which covers an intermediate region, for example, a gap between two elements of a wing surface where lacquer is applied directly to a work surface on either side of the masking.

The rearward removal delimiter is arranged behind the lacquer application unit in the application direction, i.e., the pick-up device is arranged between the rearward removal delimiter and the lacquer application unit so that masking can be removed which is provided in the application direction ahead of an area to which lacquer has been applied with the device. Hence, if a rearward removal delimiter is provided, an end masking may be removed that covers an end region where the lacquer application is stopped or an intermediate masking may be removed that is used to cover, for example, a gap between two elements of a wing surface where lacquer is applied to a work surface on either side of the masking.

In a further preferred embodiment at least one of the masking removal unit and the masking application unit is movably attached to the lacquer application unit such that the at least one of the masking removal unit and the masking application unit can be held stationary relative to the work surface for a predetermined period of time to respectively enable removal or application of a masking while at least the lacquer application unit moves in the application direction at a predetermined application velocity. This is in particular preferred for any kind of masking removal unit described herein in more detail and for those masking application units comprising a pick-and-placed unit.

In other words, in the preferred embodiment the entire device and, in particular, the lacquer application unit is moved in the application direction at a predetermined velocity to provide a predetermined lacquer structure or pattern. This may, for example, be achieved using a robot arm holding the device and moving it forward or by mounting the device to a crane which moves the device forward. When a masking needs to be removed from the work surface or applied thereto, the respective masking removal unit or masking application unit is moved relative to the remainder of the device and, in particular, the lacquer application unit at a velocity and in a direction extending antiparallel to the application direction such that the respective masking removal unit or masking application unit remains stationary relative to the work surface for a predetermined time. The predetermined time is chosen such that, for example, any required removal delimiter may be lowered in a position such that it applies pressure or cuts the lacquer and a pick-up unit can detach or remove the masking from the work surface or that a sheet can be accurately placed on the work surface. As the respective masking removal unit or the masking application unit preferably remains stationary relative to the work surface while the masking is removed or placed, an accurate removal or placement of the masking is enabled. Further, damages created by dragging, for example, a pick-up unit, a removal delimiter or any other part of the masking removal unit across an area recently covered with lacquer may be prevented.

In an example embodiment, the lacquer application unit comprises a frame, a transfer roller, a lacquer dispensing unit and a drive unit, wherein the drive unit is configured to drive the transfer roller in a rotation direction about an axis of rotation relative to the frame and wherein the transfer roller is configured to roll with an outside contact surface on a work surface of a work piece for transferring a structure provided on the outside contact surface in lacquer dispensed by the lacquer dispensing unit to the work surface of the work piece to create the defined lacquer structure on the work surface.

In another aspect the problem is solved by a method of operating a device for lacquer transfer according to any of the preceding embodiments comprising a masking application unit, wherein the method comprises the steps of applying a first masking to a work surface using the masking application unit while moving the device in the application direction, commencing to apply lacquer using the lacquer application unit to the work surface in an area where the work surface has previously been covered with the first masking and continue moving the device in the application direction such that lacquer is applied on the first masking and afterwards directly onto the work surface. The device is preferably moved at a predefined velocity in the application direction during all steps.

The method further preferably comprises the subsequent steps of applying a second masking to the work surface using the masking application unit while moving the device in the application direction, continuing to move the device into the application direction until the lacquer is being applied in an area where the work surface has previously been covered with the second masking and stop applying lacquer to the second masking and the work surface.

In a further aspect the problem is solved by method of operating a device for lacquer transfer according to any of the preceding embodiments comprising a masking removal unit, wherein the method comprises the steps of commencing to apply lacquer using the lacquer application unit to a work surface in an area where the work surface has previously been covered with a first masking, moving the device in the application direction such that lacquer is applied on the first masking and directly onto the work surface, when lacquer is being applied directly onto the work surface, remove the first masking using the masking removal unit.

The method further preferably comprises the steps of continuing to move the device into the application direction until the lacquer is being applied to a work surface in an area where the work surface has previously been covered with a second masking, stop applying lacquer to the second masking and the work surface but continue moving the device in the application direction and when applying the lacquer has been stopped, remove the second masking using the masking removal unit.

It is further preferred that the step of removing the first masking using the masking removal unit comprises exerting a pressure onto lacquer already applied by the lacquer application unit onto the work surface using the at least one removal delimiter and lifting the first masking from the work surface using the pick-up device while the pressure is applied by the at least one removal delimiter.

It is further preferred that the step of removing the second masking using the masking removal unit comprises exerting a pressure onto lacquer already applied by the lacquer application unit onto the work surface using the at least one removal delimiter and lifting the second masking from the work surface using the pick-up device while the pressure is applied by the at least one removal delimiter.

In a preferred embodiment the step of removing the first and/or the second masking from the work surface includes the step of moving the masking removal unit relative to the lacquer application unit such that the masking removal unit is held stationary relative to the work surface while the first and/or second masking is removed from the work surface using the masking removal unit whereas the lacquer application unit continues to move in the application direction. It is further preferred that the step of applying the first and/or the second masking to the work surface includes the step of moving the masking application unit relative to the lacquer application unit such that the masking application unit is held stationary relative to the work surface while the first and/or second masking is applied to the work surface using the masking application unit whereas the lacquer application unit continues to move in the application direction. The latter method is particular useful if a pick-and-place unit is part of the masking application unit.

It is respectfully submitted that both the masking application unit and the masking removal unit including their respective embodiments and the aspects of the methods of operating relating to the masking application unit and the masking removal unit form independent inventive concept that solve the problem underlying the disclosure herein also by themselves and, in particular, without having to be combined with a lacquer application unit.

Finally, in a further aspect the problem is solved by a method of operating a device according to any of the preceding embodiments that comprises both a masking application unit and a masking removal unit, wherein the method involves at least one of the preferred embodiments of the method for operating a device for lacquer transfer comprising a masking application unit and one of the preferred embodiments of the method for operating a device for lacquer transfer comprising a masking removal unit.

The advantages of the method of operating a device for lacquer transfer correspond to the advantages of the respective device which is operated.

BRIEF DESCRIPTION OF THE DRAWINGS

In the following the disclosure herein will be described in more details with reference to example embodiments of devices shown in the drawings, wherein.

DETAILED DESCRIPTION

Figure 1A:
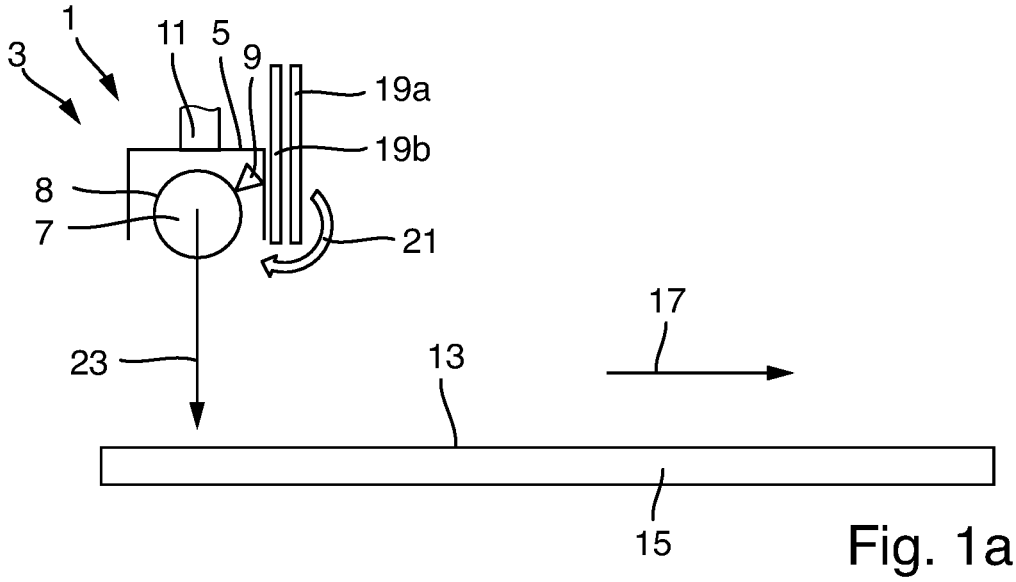
FIGS. 1*a* through 1*e* show an example embodiment of a method for operating a device for lacquer transfer.

In the following description of the Figures, like elements of the drawings will be designated with like reference numerals.

FIGS. 1*a* through 1*e* show an example embodiment method of operating a device 1 for lacquer transfer using a simplified drawing of a device 1. The device 1 comprises a lacquer application unit 3 with a frame 5, a transfer roller 7 and a lacquer dispensing unit 9. The transfer roller 7 is rotatably attached to the frame 5 and can be driven in rotation by a drive or motor not shown in the drawings. The motor may, for example, be arranged inside the transfer roller 7.

The device 1 is attached to a robot arm 11 of a robot which is only partly shown in the Figures. The robot arm 11 moves the device 1 across a work surface 13 of a work piece 15 in an application direction 17 at a constant and predetermined velocity. The transfer roller 7 is configured to roll with an outside contact surface 8 on the work surface 13 of the work piece 15 for transferring a structure provided on the outside contact surface 8 in lacquer dispensed by the lacquer dispensing unit 9 to the work surface 13 of the work piece 15 to create the defined lacquer structure on the work surface 13. The structure on the outside contact surface 8 is not shown in the Figures as it is a microstructure that is not visible at the scale in which the drawings are provided. The work piece 15 may, for example, be a wing of an aircraft and the work surface 13 may be a surface which is subject to flow surrounding the wing when the aircraft is in flight.

The device 1 further comprises a masking application unit and a masking removal unit. The structures of these units are not shown in FIGS. 1*a* to 1*e* to keep the drawings as intelligible as possible. Instead a first and a second masking element 19*a*, 19*b* are shown in the Figures to facilitate understanding of the operation of the masking application unit and the masking removal unit.

Figure 1B:
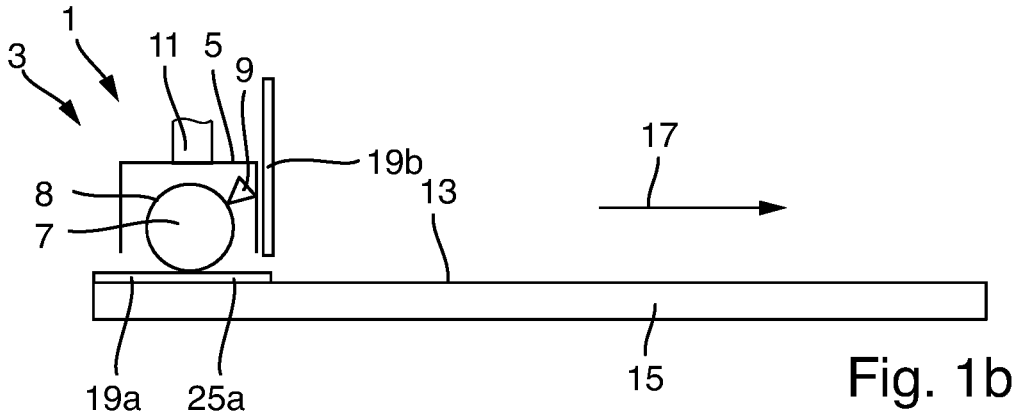

As indicated by a rotating arrow 21 in FIG. 1*a*, in a first step a first masking element 19*a* is dispensed using the masking application unit onto the work surface 13. Afterwards the device 1 is lowered in a downward direction 23 onto the work piece 15 in an area which has previously been covered by the first masking element 19*a*. In this way the first masking element 19*a* forms a first masking 25*a* as shown in FIG. 1*b*. By providing a first masking 25*a* and afterwards lowering the device 1 onto the first masking 25*a* before commencing applying lacquer onto the work surface 13 irregularities in the structure applied in lacquer to the work surface 13 are prevented.

Figure 1C:
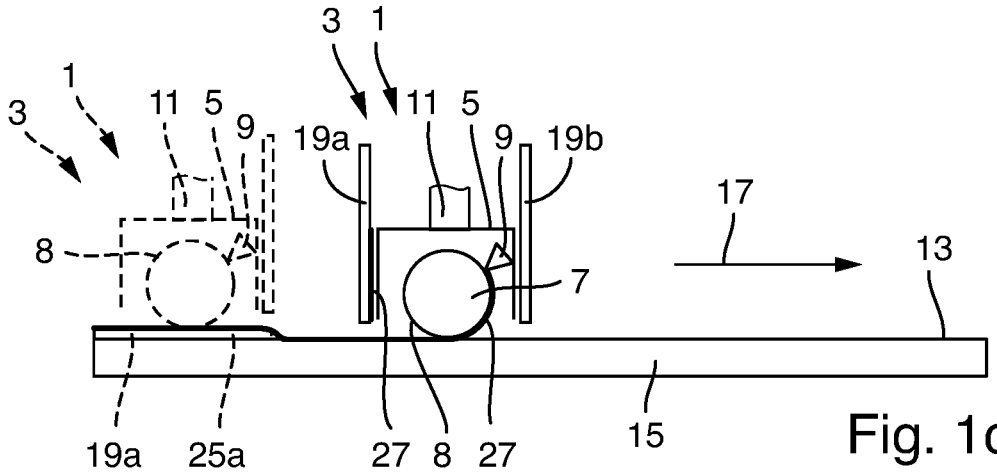

FIG. 1*c* shows in dashed lines the original position in which the device 1 had been lowered onto the work piece 15. The device 1 has meanwhile been moved by the robot arm 11 in the application direction 17 for some distance as indicated by the device 1 shown in continuous lines. Lacquer 27 with an embossed microstructure has been transferred from the lacquer dispensing unit 9 to the work surface 13 and the first masking 25*a* formed by the first masking element 19*a*. While the device 1 has been moved forward, the masking removal unit has been used to fold the first masking element 19*a* upwards whereby the first masking 25*a* is automatically removed from the work surface 13. Advantageously no manual work was required to apply and remove the first masking 25*a*.

Figure 1D:
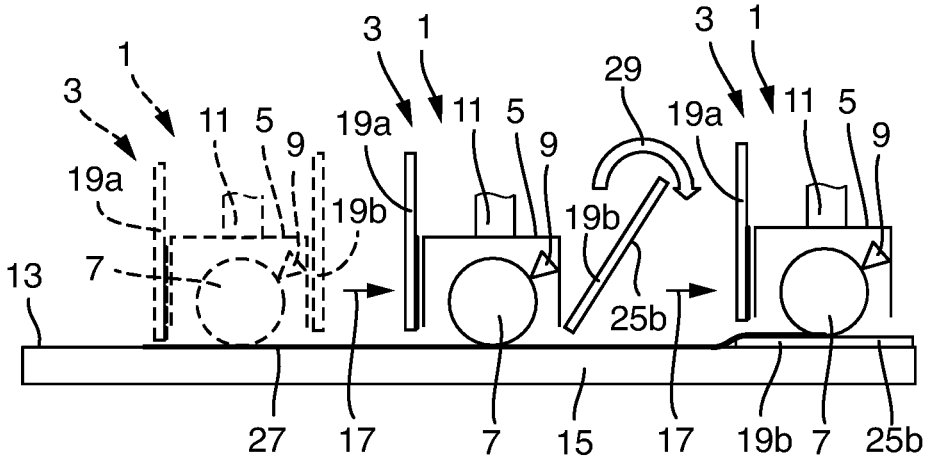

In FIG. 1*d*, the position of the device 1 of FIG. 1*c* is shown in dashed lines. The device 1 is additional shown in two further positions in continues lines. In the left of the two positions, the device 1 has been moved by the robot arm 11 close to a position in which application of lacquer with the embossed structure will be stopped. While the device 1 is continuously being moved forward, the second masking element 19*b* is dispensed on the work surface 13 by lowering it towards the work piece 13 as indicated by a rotating arrow 29. Note that when the second element 19*b* is lowered onto the work piece 13, the area onto which it is lowered is not yet covered by lacquer 27 as the masking application unit travels in the application direction 17 ahead of the lacquer dispensing unit 3.

The second masking element 19*b* then forms a second masking 25*b* onto which the device 1 is eventually moved by the robot arm 11. Once the device 1 has been moved onto the second masking 25*b*, no more lacquer is applied, for example, by stopping the dispensing of lacquer from the lacquer dispensing unit 9 and by stopping the rotation of the transfer roller 7.

Figure 1E:
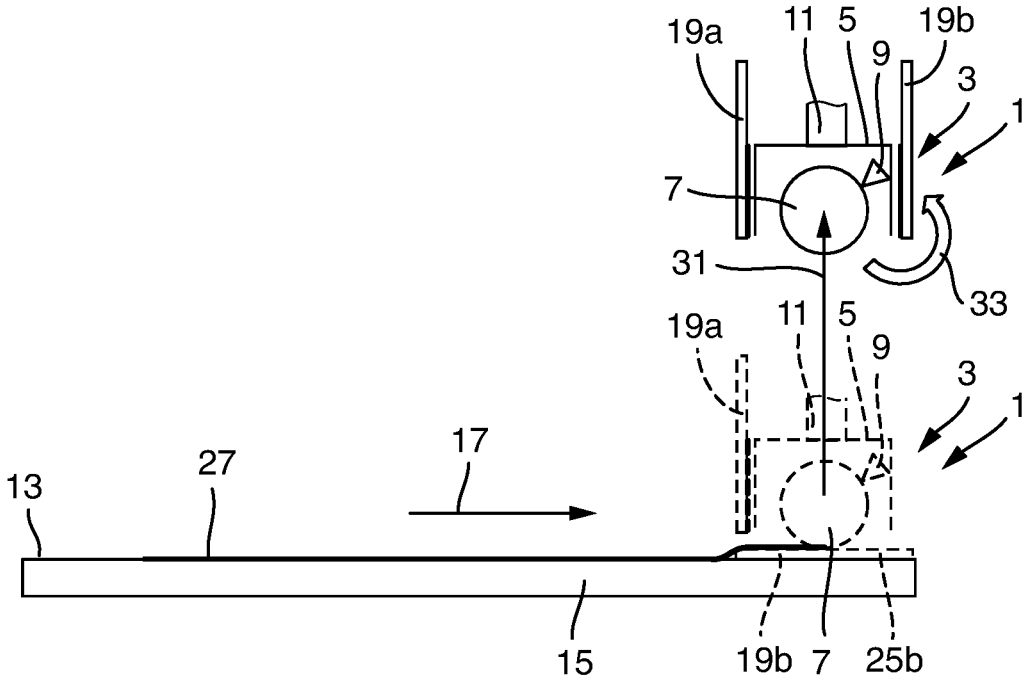

In the next step shown in FIG. 1*e*, the device 1 has been lifted of the work surface 13 and away from the work piece 15 in a direction 31. While the device 1 is moved away from the work surface 13, the masking removal unit has been operated to remove the second masking 25*b* from the work surface 13 as indicated by the masking element 19*b* which has been brought back up into an upright position indicated in solid lines in FIG. 1*e*. The removal of the second masking 25*b* is indicated by a rotating arrow 33.

The device 1 therefore advantageously allows for the application and removal of a second masking 25*b* which covers the work surface 13 of a work piece 15 in a region where the application of lacquer is terminated or stopped.

Figure 2:
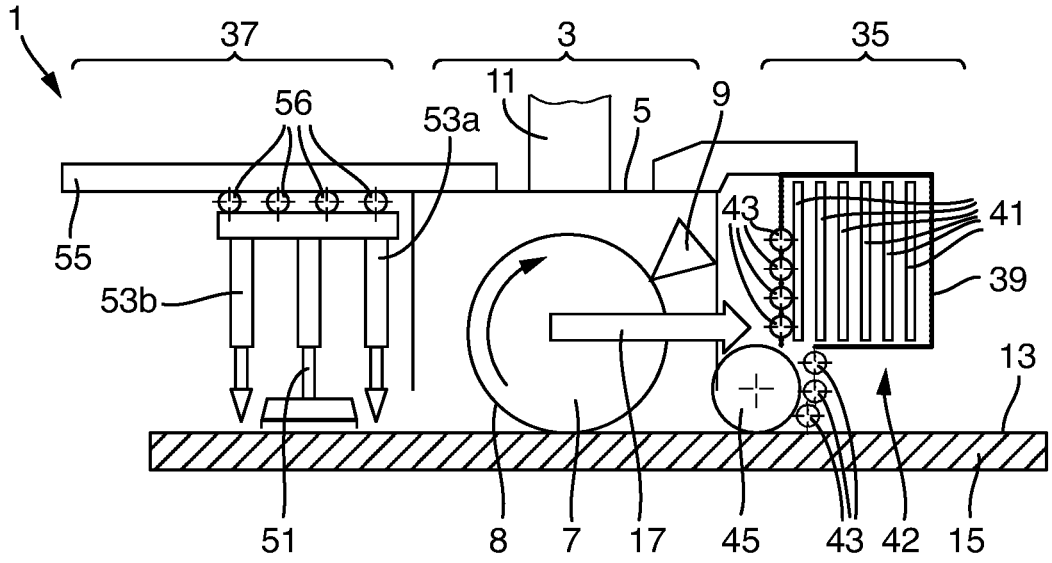
FIG. 2 shows an example embodiment of a device for lacquer transfer comprising a masking removal unit and a masking application unit.

FIG. 2 shows an example embodiment of a device 1 for lacquer transfer. The device 1 comprises a lacquer application unit 3, a masking application unit 35 and a masking removal unit 37. The device 1 is attached to a robot arm 11 which is only partly shown in FIG. 1.

The lacquer application unit 3 is also shown in FIGS. 1*a* through 1*e* which has already been described with reference to FIG. 1*a* in more detail. For the sake of brevity, the description of the elements of the lacquer application unit 3 is not repeated again here.

The masking application unit 35 is attached to the frame 5 of lacquer application unit 3 such that when the device 1 is moved in the application direction 17, the masking application unit 35 moves ahead of the lacquer application unit 3 across the work surface 13 of the work piece 15. The masking application unit 35 comprises a reservoir 39 for holding masking elements 41 in the form of separate sheets that can be dispensed to the work surface 13 via a feeder unit 42 comprising a plurality of feed rollers 43. Also provided is a press roller 45 for pressing masking elements 41 to the work surface 13 to prevent the masking elements 41 from moving away or evading when they come into contact with the transfer roller 7 which could deteriorate the quality of the structure of the lacquer 27 applied to the work surface 13.

Figure 3:
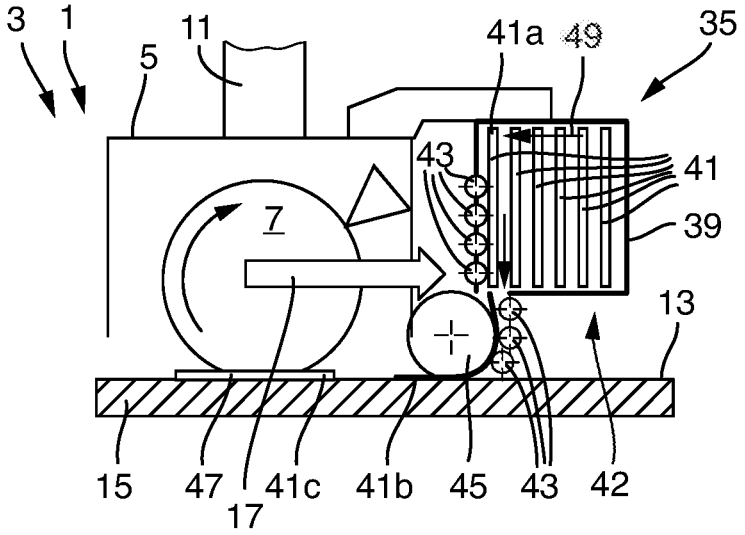
FIG. 3 shows an example embodiment of a device for lacquer transfer comprising a masking application unit.

Operation of the masking application unit 35 will now be described with reference to FIG. 3 in which dispensing of a masking element 41*a*, 41*b*, 41*c* from the reservoir 39 is shown. In FIG. 3 a device 1 for lacquer transfer is shown which comprises the lacquer transfer unit 3 and the masking application unit 35 of FIG. 2 but no masking removal unit 37. However, it is contemplated that the masking application unit 35 of FIG. 2 is operated in the same way and the following description applies to both embodiments. As the lacquer application units 3 and the masking application units 35 of FIGS. 2 and 3 are structurally identical, reference is made to the preceding description of the relevant components.

In FIG. 3 the same masking element 41 is shown in three different positions while it is being dispensed onto a work surface 13. In each position the masking element 41 is designated with a different reference numeral. First a masking element 41 is pushed in a direction 49 into a position 41*a* in the reservoir 39 from which it can be fed using the feeder unit 42. In the second position 41*b* the masking element 41 is transported by the feed rollers 43 of the feeder unit 42 towards the work surface 13 and tightly pressed against the work surface 13 using the press roller 45. Eventually the masking element 41 has been applied to the work surface 13 as shown in position 41*c* and forms a masking 47 which masks a part of the work surface 13. As the device 1 is moved by the robot arm 11 forward in the application direction 17 while the masking element 41 is being dispensed, the transfer roller 7 will move across the masking element 41. The masking element 41 prevents lacquer transferred by the transfer roller 7 from coming into contact with the work surface 13 in the area covered by the masking element 41.

The masking removal unit 37 of the device 1 of FIG. 2 comprises a pick-up device 51 and two removal delimiters 53*a*, 53*b*, a forward removal delimiter 53*a* and a rearward removal delimiter 53*b*. The pick-up device 51 may, for example, be a single large-area air suction device or may be made from multiple individual devices arranged in a grid. The masking removal unit 37 is attached to the lacquer application unit 3 such that when the device 1 is moved by the robot arm 11 in the application direction 17 the masking removal unit 37 is arranged behind the lacquer application unit 3 in the application direction 17, i.e., the lacquer application unit 3 crosses the work surface 13 ahead of the masking removal unit 37. The forward removal delimiter 53*a* is arranged between the pick-up device 51 and the lacquer dispending unit 3 and the pick-up device 51 is arranged between the rearward removal delimiter 53*b* and the lacquer dispensing unit 3. The pick-up device 51 could also be used as a pick-and-place device in a masking application unit 35.

For mounting of the masking removal unit 37 on the lacquer dispenser unit 3 a rail 55 is provided to which the pick-up device 51 and the removal delimiter 53*a*, 53*b* have been attached such that they can be moved relative to the remainder of the device 1 and, in particular, to the lacquer dispending unit 3. The mounting can, for example, be achieved using rollers 56 mounted on the rail 55.

Figure 4A:
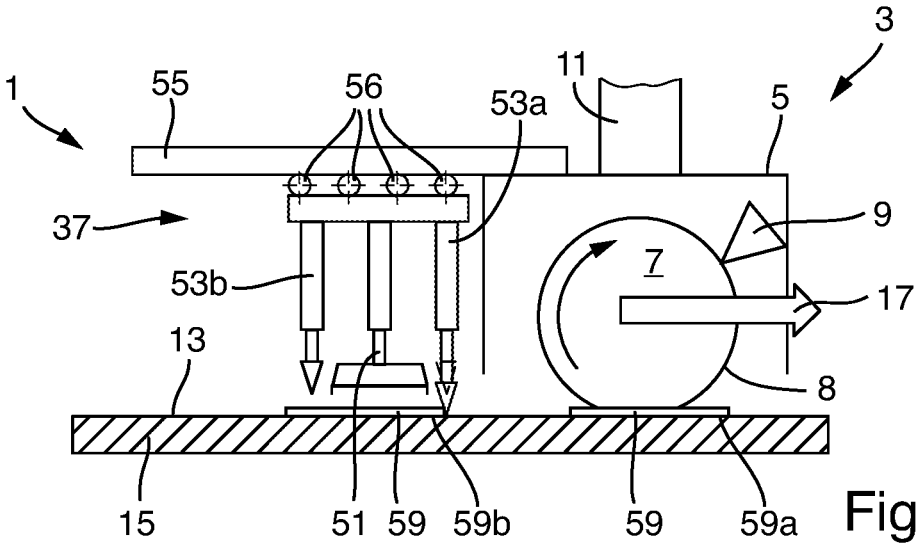
FIGS. 4*a* through 4*c* show an example embodiment of a device for lacquer transfer comprising a masking removal unit.
Figure 4B:
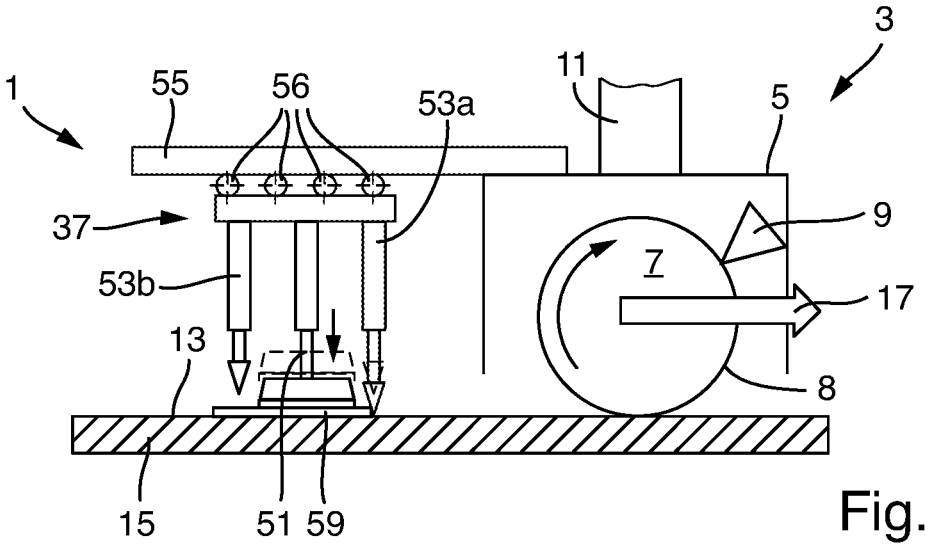
Figure 4C:
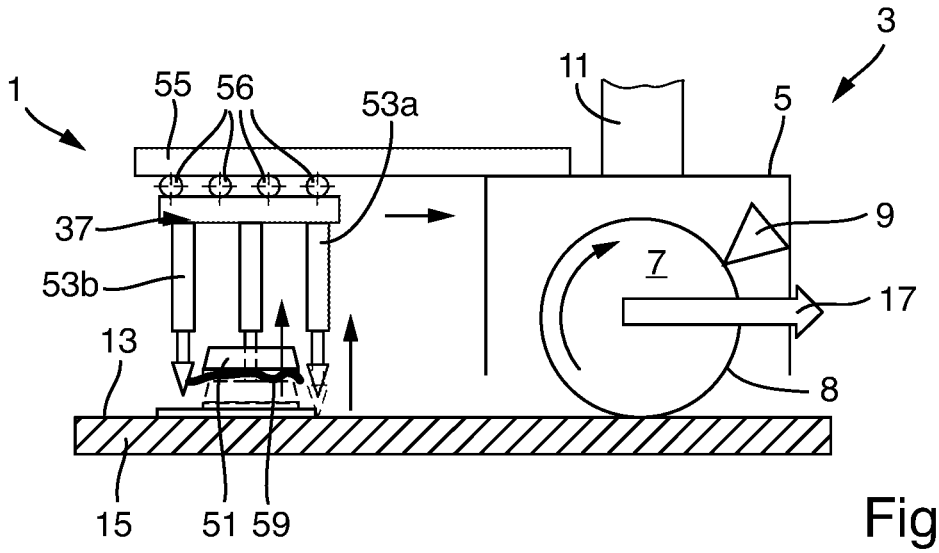

Operation of the masking removal unit 37 will now be described with reference to FIGS. 4*a* through 4*c* in which removal of a masking 59 is shown. FIGS. 4*a* through 4*c* show a device 1 for lacquer transfer comprising only a masking removal unit 37 in addition to the lacquer transfer unit 3. However, it is understood that both the masking removal unit 37 and the lacquer transfer unit 3 in FIGS. 2 and 4*a* through 4*c* are structurally identical and operate in accordance with the same methods. Hence, the structural features will not be repeated and it is contemplated that the operation shown in FIGS. 4*a* to 4*c* and described in the following also applies to device 1 of FIG. 2.

FIG. 4*a* shows a masking 59 which has previously been at least partly crossed by the transfer roller 7 of the lacquer application unit 3 as indicated in position 59*a*. Since the device 1 continuously moves into the application direction 17, the masking 59 will eventually not be underneath the transfer roller 7 any further as shown in position 59*b* and can be removed or detached from the work surface 13 using the masking removal unit 37.

To this end as shown in FIG. 4*a*, at first a forward removal delimiter 53*a* is lowered towards the device such that it exerts a pressure onto lacquer (not shown) previously applied and holds the lacquer down. Note that the forward removal delimiter 53*a* exerts its pressure against a part of the work surface 13 that is not covered by the masking 59 to be removed. The forward removal delimiter 53*a* and the rearward removal delimiter 53*b* may be formed from a plurality of individual elements or a flexible material so that they can be used to hold the lacquer down along masking elements of complex shapes.

In FIG. 4*b* additionally the pick-up unit 51, which may be a suction device, has been lowered onto the masking 59. As the device 1 for lacquer transfer continues to move in the application direction 17, the masking removal device 37 is moved on the rail 55 relative to the lacquer application unit 3 away from the latter at a velocity such that it remains stationary relative to the work surface 13 for the time required to remove the masking 59.

In FIG. 4*c* the masking 59 has been removed from the work surface 13 using the pick-up device 51. The forward removal delimiter 53*a* is moved upwards and thereby discontinues holding the lacquer down after removal of the masking 59 has been completed to ensure that the lacquer is only detached in the region facing away from the lacquer dispensing unit 3. In the same way, the rearward removal delimiter 53*b* can be used to delimit detaching of the lacquer in a direction facing away lacquer dispending unit 3. The removal delimiters 53*a*, 53*b* advantageously define the edges between areas of the work surface 13 covered by lacquer and those not covered by lacquer.

While at least one example embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the example embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for lacquer transfer comprising:

a lacquer applicator configured, while moving in an application direction across a work surface of a work piece, to apply lacquer with a defined lacquer structure to the work surface;

a masking applicator, which is configured to apply a masking to the work surface and is attached to the lacquer applicator such that the masking application moves in the application direction ahead of the lacquer applicator across the work surface when the lacquer applicator moves across the work surface in the application direction; and a masking remover, which is configured to remove the masking, which is a previously applied masking, from the work surface and is attached to the lacquer applicator such that the masking remover moves in the application direction behind the lacquer applicator across the work surface when the lacquer applicator moves across the work surface in the application direction.

2. The device of claim 1, wherein the masking applicator comprises:

a reservoir configured to hold a masking material; and a feeder unit configured to transport the masking material from the reservoir to the work surface.

3. The device of claim 2, wherein the masking applicator comprises a pick-and-place unit for selectively picking the masking material from the reservoir and placing the masking material on the work surface.

4. The device of claim 3, wherein:

the reservoir is configured to provide the masking material in discontinuous sheets of predetermined size; or the reservoir is configured to provide the masking material in continuous form.

5. The device of claim 2, wherein:

the reservoir is configured to provide the masking material in discontinuous sheets of predetermined size; or the reservoir is configured to provide the masking material in continuous form.

6. The device of claim 2, wherein the masking applicator comprises a cutting arrangement configured for cutting the masking material in at least one of a direction extending perpendicular to the application direction and a direction extending parallel to the application direction.

7. The device of claim 1, wherein the masking applicator comprises a press roller for pressing the masking material to the work surface.

8. The device of claim 1, wherein the masking remover comprises:

a pick-up device configured for lifting the masking from the work surface; and at least one removal delimiter configured to temporarily exert a pressure onto lacquer applied by the lacquer applicator to the work surface for delimiting an area in which the lacquer detaches from the work surface when the pick-up device lifts the masking from the work surface.

9. The device of claim 8, wherein:

the at least one removal delimiter comprises a rearward removal delimiter;

the pick-up device is arranged between the lacquer applicator and the rearward removal delimiter; and the rearward removal delimiter is configured to exert a pressure onto the lacquer applied by the lacquer applicator to the work surface for delimiting the area in which the lacquer detaches from the work surface when the pick-up device lifts the masking from the work surface in a direction extending antiparallel to the application direction; and/or wherein:

the at least one removal delimiter comprises a forward removal delimiter;

the forward removal delimiter is between the lacquer applicator and the pick-up device; and the forward removal delimiter is configured to exert a pressure onto the lacquer applied by the lacquer applicator to the work surface for delimiting the area in which the lacquer detaches from the work surface when the pick-up device lifts the masking from the work surface in a direction extending parallel to the application direction.

10. The device of claim 9, wherein the at least one removal delimiter is formed as a blade or scraper for cutting the lacquer applied to the work piece.

11. The device of claim 1, wherein:

the masking remover is movably attached to the lacquer applicator such that the masking remover can be held stationary relative to the work surface for a predetermined period of time to enable removal of the masking while at least the lacquer applicator moves in the application direction at a predetermined velocity; and/or the masking applicator is movably attached to the lacquer applicator such that the masking applicator can be held stationary relative to the work surface for a predetermined period of time to enable application of the masking while at least the lacquer applicator moves in the application direction at the predetermined velocity.

12. A method of operating a device for lacquer transfer, the method comprising:

providing the device for lacquer transfer, the device comprising:

a lacquer applicator that is movable in an application direction across a work surface of a work piece, to apply lacquer with a defined lacquer structure to the work surface;

a masking applicator that can apply a masking to the work surface and is attached to the lacquer applicator such that the masking application moves in the application direction ahead of the lacquer applicator across the work surface when the lacquer applicator moves across the work surface in the application direction; and a masking remover that can remove the masking, which is a previously applied masking, from the work surface and is attached to the lacquer applicator such that the masking remover moves in the application direction behind the lacquer applicator across the work surface when the lacquer applicator moves across the work surface in the application direction;

applying, using the masking applicator, a first masking to the work surface while moving the device in the application direction;

applying lacquer, using the lacquer applicator, to the work surface in an area where the work surface has previously been covered with the first masking;

moving the device in the application direction such that lacquer is applied on the first masking and directly onto the work surface;

applying, using the masking applicator, a second masking to the work surface while moving the device in the application direction;

moving the device in the application direction until the lacquer is being applied in an area where the work surface has previously been covered with the second masking; and stopping application of the lacquer to the second masking and the work surface.

13. The method of claim 12, comprising:

removing, using the masking remover, the first masking when the lacquer is being applied directly onto the work surface;

removing, using the masking remover, the second masking after application of the lacquer has been stopped.

14. The method of claim 13, wherein:

pressing, using a press roller of the masking applicator, the masking material to the work surface;

lifting, using a pick-up device of the masking remover, the masking from the work surface;

temporarily exerting, using at least one removal delimiter of the masking remover, a pressure onto the lacquer applied to the work surface by the lacquer applicator for delimiting an area in which the lacquer detaches from the work surface when the pick-up device lifts the masking from the work surface; and removing the first masking using the masking remover comprises:

exerting, using the forward removal delimiter, a pressure onto lacquer already applied onto the work surface by the lacquer applicator; and lifting, using the pick-up device, the first masking from the work surface while the pressure is applied by the forward removal delimiter.

15. The method of claim 14, wherein removing the second masking using the masking remover comprises:

exerting, using the at least one removal delimiter, a pressure onto lacquer already applied onto the work surface by the lacquer applicator; and lifting, using the pick-up device, the second masking from the work surface while the pressure is applied by a rearward removal delimiter of the at least one removal delimiter.

16. The method of claim 13, wherein the at least one removal delimiter is formed as a blade or scraper for cutting the lacquer applied to the work piece; and wherein:

removing the first masking and/or the second masking from the work surface comprises moving the masking remover relative to the lacquer applicator such that the masking remover is held stationary relative to the work surface while the first masking and/or the second masking is removed from the work surface using the masking remover, while the lacquer applicator continues to move in the application direction; and/or applying the first masking and/or the second masking to the work surface comprises moving the masking applicator relative to the lacquer applicator such that the masking applicator is held stationary relative to the work surface while the first masking and/or the second masking is applied to the work surface using the masking applicator, while the lacquer application applicator unit continues to move in the application direction.

* * * * *